US005419707A

United States Patent [19]

Kelley

[11] Patent Number: 5,419,707

[45] Date of Patent: May 30, 1995

[54] SWIVEL ELECTRICAL CONNECTOR

[76] Inventor: Shawn T. Kelley, 9717 Hillsmere Rd., Ellicott City, Md. 21042

[21] Appl. No.: 169,214

[22] Filed: Dec. 17, 1993

[51] Int. Cl.[6] ..... H01R 39/64

[52] U.S. Cl. ..... 439/21; 439/6; 439/668

[58] Field of Search ..... 439/676, 668, 669

[56] References Cited

U.S. PATENT DOCUMENTS

| | | | |
|---|---|---|---|
| 1,178,267 | 4/1916 | Scheel | 439/668 |
| 3,437,976 | 4/1969 | Nelson | 439/23 |
| 4,273,969 | 6/1981 | Foley et al. | 439/13 X |
| 4,557,536 | 12/1985 | Geurts . | |
| 4,590,337 | 5/1986 | Engelmore | 439/21 |
| 4,850,880 | 7/1989 | Zayat, Jr. et al. . | |
| 4,894,014 | 1/1990 | Palus et al. . | |
| 5,074,796 | 12/1991 | Carter . | |
| 5,180,317 | 1/1993 | Franks, Jr. . | |

*Primary Examiner*—Eugene F. Desmond
*Attorney, Agent, or Firm*—Richard C. Litman

[57] ABSTRACT

An electrical connector providing a plurality of electrical contacts and which allows for 360° rotation, while providing interruption free electrical continuity, is disclosed. A first set of electrical contacts is movably connected to a second set of electrical contacts through the employment of movably engaging terminal and conductive pads. The two pads are permitted to rotate relative to one another. Hence, the two connectors are permitted to rotate relative to one another. The electrical connector may be provided with a universal joint assembly. The universal joint assembly would permit the first and second connectors to be angularly displaced relative to one another and about a respective arbitrary axis. Preferably, the axes extend normal to one another.

13 Claims, 3 Drawing Sheets

18
14
16
32
20
46
40
36
34
68
54
50
44
42
70
48
38
64
66
58
52
60
62
104
26
84
82
88
100
72
80
56
86
102
96
76
74
90
124
118
120
92
94
114
108
24a
78
110
98
112
116
106
122
10a

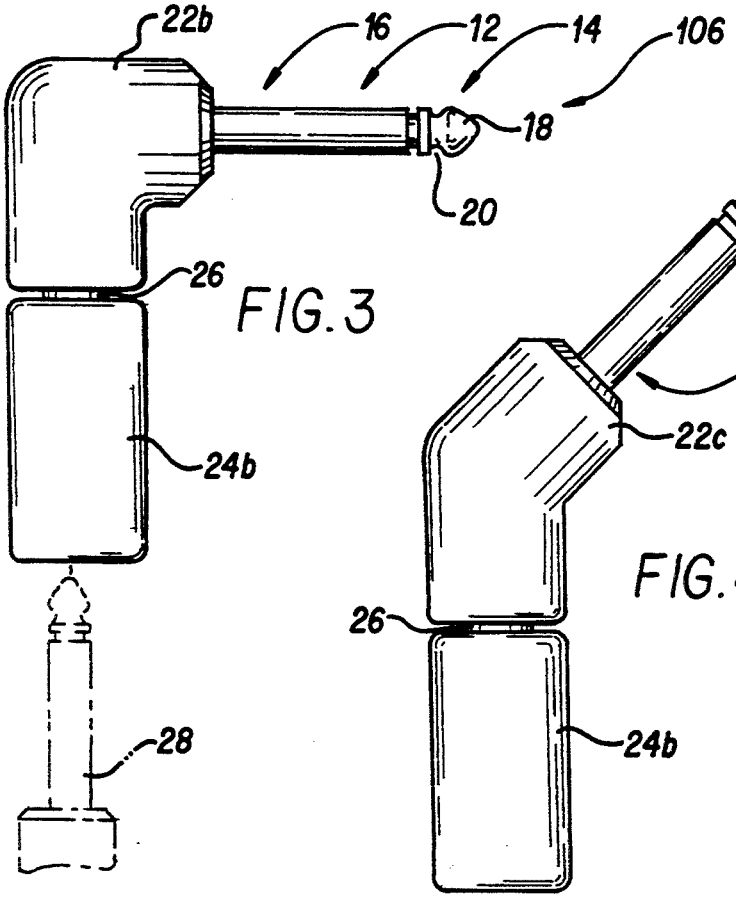
FIG. 3
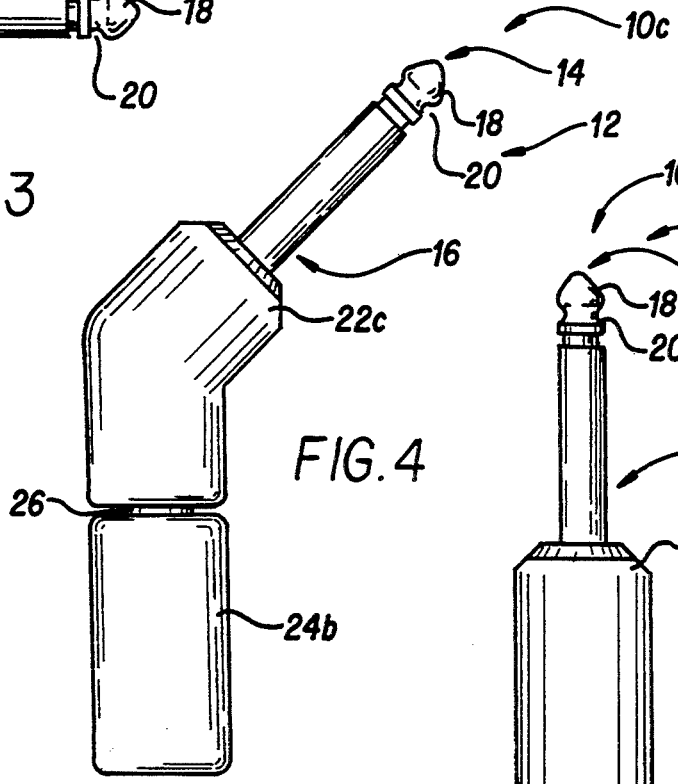
FIG. 4
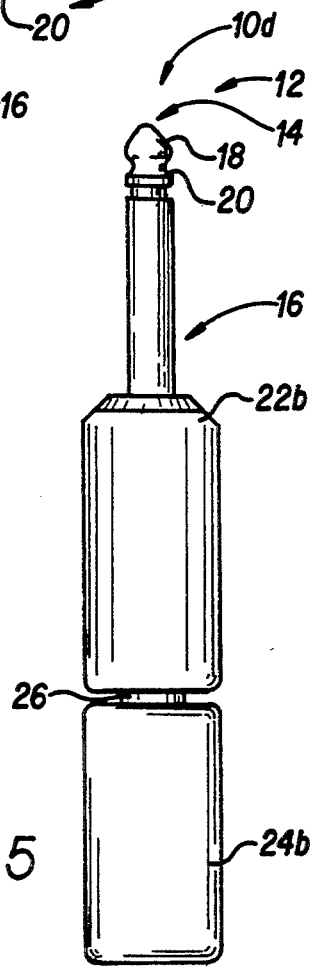
FIG. 5
FIG. 2
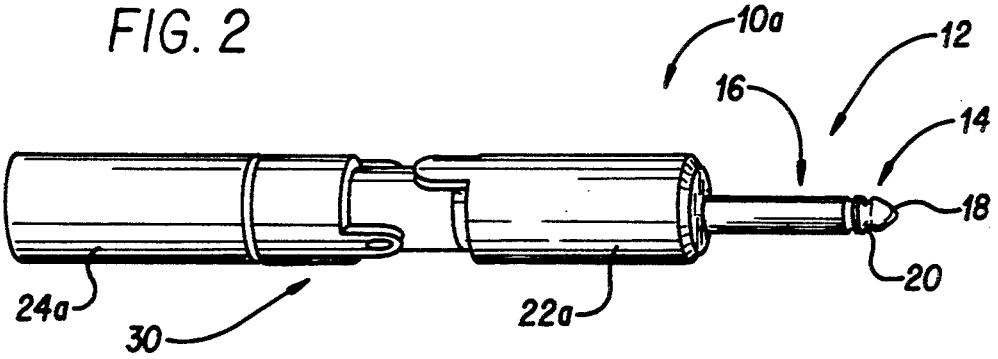

SWIVEL ELECTRICAL CONNECTOR

BACKGROUND OF THE INVENTION

1. Field of the Field

The present invention relates to electrical connectors providing a plurality of contacts and, more particularly, to an electrical connector which allows for 360° rotation, while providing interruption-free electrical continuity.

2. Description of the Prior Art

It can be quite cumbersome to handle an electrical device or appliance that relies on a source at, or that transmits a signal to, a remote location. For example, a musician may be inclined to move about with an electrical musical instrument, such as an electrical guitar, twisting and tangling the signal transmission cord. This twisting and tangling creates radial energy in the cord. Handling of other devices, such as microphones and headphone, or appliances, such as power tools and household appliances, may be troublesome as well when the user of the device or appliance is moving about. Wireless devices have been devised to omit the need for transmission cords and eliminate the problems associated with the same. Wireless devices and appliances are known to be costly. Moreover, wireless devices and appliances require an independent power source which requires periodic replacement or recharging. Further, wireless devices and appliances may require a transmitting or receiving means which, in combination with the source, may be burdensome. An alternative to a wireless device or appliance having a power or transmission cord which resists twisting and tangling could prove to be invaluable.

There have been several attempts to devise a device having electrical contacts which provide freedom of movement. For example, U.S. Pat. No. 4,850,880, issued Jul. 25, 1989 to Charles D. Zayat, Jr. et al., discloses a device having two separate sets of contacts and a pivotal axis allowing 360° of rotational freedom between the two sets of contacts. The device is configured to release radial mechanical energy stored in a cord due to repeated twisting of the device attached to the cord. The device provides a continuous electrical connection between the two sets of contacts, by providing rotary contacts which allow interruption free electrical continuity during the full 360° of rotation. The device utilizes a center core member carrying one set of contacts rotatably mounted within an outer housing carrying complementary contacts. The core and housing members provide free rotation to avoid tangling.

Another rotatable coupling is shown in U.S. Pat. No. 4,557,536, issued Dec. 10, 1985 to Jan V. M. Geurts. Geurts discloses a rotatable electrical coupling having a cylindrical housing enclosing two resilient contact members and a circumferential groove formed in its inner surface. The cable holder has two slip rings respectively cooperating with the two contact members. The slip rings are formed as coaxial cylindrical conductors of different diameters. A connection cable is embedded in the cable holder and has two conducting cores respectively electrically connected to the two slip rings. A hollow substantially cylindrical insulating body electrically separates the two slip rings from each other.

Yet another apparatus for preventing the twisting of electrical cables is shown in U.S. Pat. No. 4,894,014, issued Jan. 16, 1990 to Joseph Palus et al. Palus et al. discloses an apparatus constructed with bearing assemblies for conducting electrical current from a fixed cable end to a rotatable cable end. The apparatus includes a housing having fixed and rotatable cable clamping devices attached thereto. The housing and the cable clamping devices cooperate to transmit tensile loads on the cable through the housing, thereby preventing wear and damage to moving electrical contacts. An idler bearing is employed to minimize torsional strains on the cable conductors by permitting the cable to rapidly change position within the housing.

Unlike the apparatuses disclosed in the aforementioned patents, U.S. Pat. No . 5,074,796, issued Dec. 24, 1991 to Andrew L. Carter, discloses a stacking multiple contact plug and socket electrical connector. The connector has a central body with a plug extending outward from one face thereof, and a socket recessed inward within an opposite face thereof. The plug includes multiple electrically conductive circular contacts rings thereabout. The socket includes multiple electrical wiper contacts spaced along an electrically insulating inner wall therein for contacting the circular contact rings of the plug. The plug and socket connector allows for rotation of the plug within the socket without loss of electrical contact with the socket.

None of the above inventions and patents, taken either singly or in combination, is seen to describe the instant invention as claimed.

SUMMARY OF THE INVENTION

The present invention relates to electrical connectors providing a plurality of electrical contacts and which allow for 360° rotation, while providing interruption-free electrical continuity. A first set of electrical contacts is movably connected to a second set of electrical contacts. This is accomplished through the employment of cooperatively engaging terminal and conductive pads. The terminal pad includes a plurality of resilient terminals. The conductive pad includes a plurality of planar, conductive rings isolated from one another by an insulating material. The terminal pad and the conductive pad are oriented relative to one another so as to compress the resilient terminals against respective conductive rings. One of the pads is fixed relative to one of the sets of contacts. The other pad is fixed relative the other set of contacts. The two pads are permitted to rotate relative to one another. Hence, the two sets of contacts are permitted to rotate relative to one another. This configuration is inexpensive, dependable and fully effective in accomplishing its intended purposes.

The two sets of contacts may be disposed in-line relative to one another or may be angularly disposed relative to one another, such as at a right angle to one another or oblique relative to one another. Alternatively, the electrical connector may be provided with a universal joint assembly. The universal joint assembly would permit the first and second sets of contacts to be angularly displaced relative to one another. Each set of contacts is displaceable about a respective arbitrary axis. Preferably, the axes extend normal to one another.

Accordingly, it is a principal object of the invention to provide electrical connectors having a plurality of electrical contacts and which allow for 360° rotation, while providing interruption free electrical continuity.

It is another object to provide a first set of electrical contacts movably connected to a second set of electrical contacts through the employment of movably engaging terminal and conductive pads which are oriented relative to one another so as to provide continuity therebetween.

It is a further object to provide an electrical connector provided with a universal joint assembly which would permit the first and second sets of electrical contacts to be angularly displaced relative to one another and about respective arbitrary axes.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 2 is a perspective view of the electrical connector shown in FIG. 1.

FIG. 3 is an environmental side elevational view of a first alternative electrical connector.

FIG. 4 is a side elevational view of a second alternative electrical connector.

FIG. 5 is a side elevational view of a third alternative electrical connector.

Similar reference characters denote corresponding features consistently throughout the attached drawings.

DETAILED DESCRIPTION OF THE PREFERRED EMBODIMENTS

Figure 1:
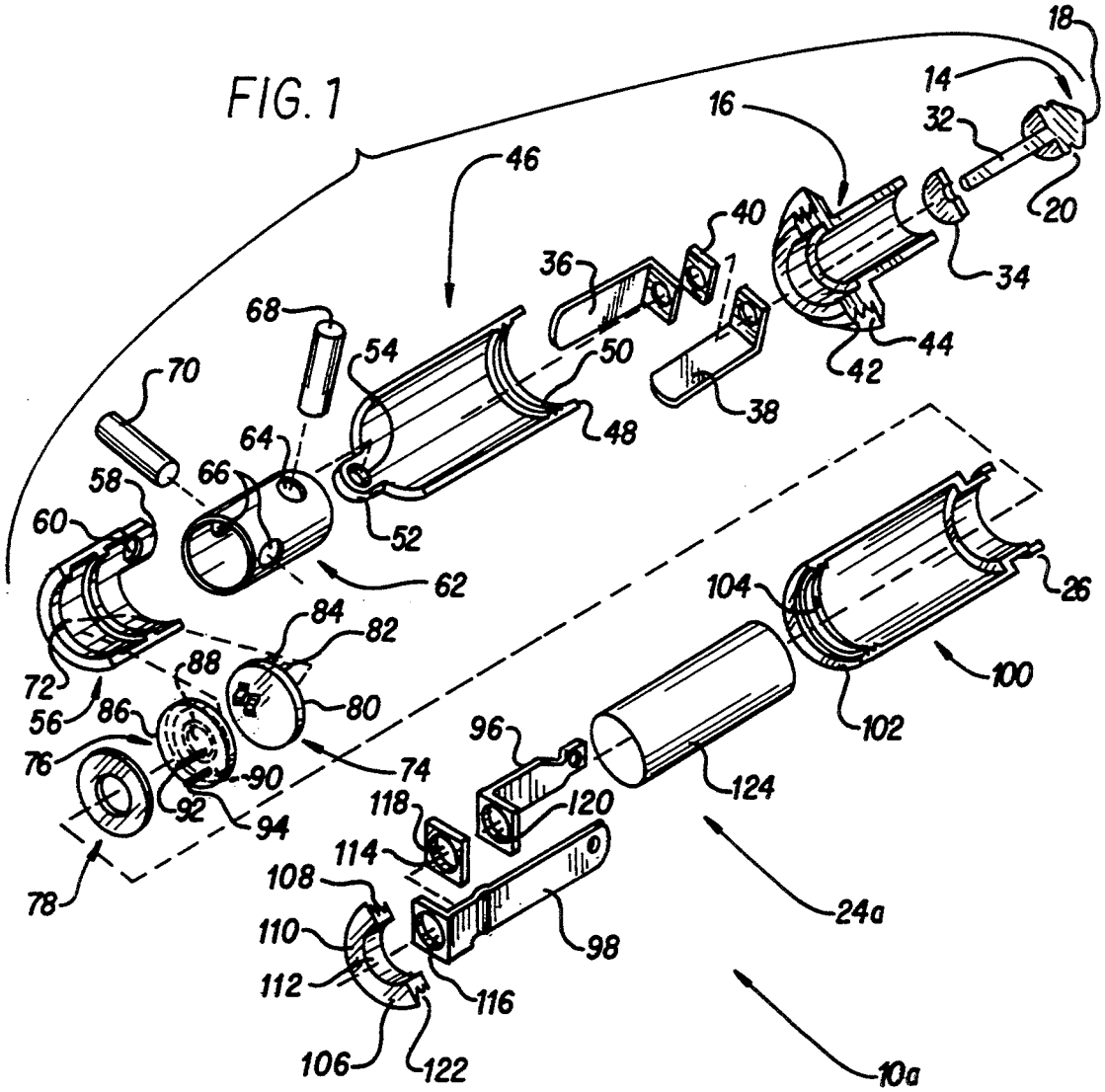
FIG. 1 is an exploded cross-sectional view of an electrical connector according to the present invention.

The present invention relates to an electrical connector 10*a*, as is shown in FIGS. 1 and 2. The electrical connector 10*a* is shown in the form of a pivotable audio connector. This electrical connector 10*a* is provided with a universal joint assembly 30. The universal joint assembly 30 permits a first receiving jack 24*a* to be displaced relative to a cap assembly 22*a*. The first receiving jack 24*a* is displaceable between at least 0° and 90° about two arbitrary axes. Preferably, the axes extend normal to one another.

The unique construction of the electrical connector 10*a* is shown in FIG. 1. FIG. 1 clearly shows a first electrical contact 14 comprising a tip end 18 and a detent groove 20 spaced from the tip end 18. A second electrical contact 16 is defined by an annular hollow outer shaft. An inner shaft 32 is integral with the tip end 18. The inner shaft 32 is insulated from and extends through the second electrical contact 16. The inner shaft 32 is angularly spaced from the second electrical contact 14 by a first spacer 34. The spacer 34 electrically insulates the first electrical contact 14 from the second electrical contact 16.

A first terminal 36 is connected to an end of the inner shaft 32 opposite the tip end 18. A second terminal 38 is spaced from the first terminal 36 by a second spacer 40. The spacer 40 electrically insulates the first terminal 36 from the second terminal 38. The second terminal 38 is connected to the second electrical contact 16. An end of the second electrical contact 16 is provided with an exterior thread 42. A first radially extending flange 44 is disposed adjacent the exterior thread 42. The first radially extending flange 44 forms a bearing surface, the utility of which will be described hereinafter.

The universal joint assembly 30 includes a first sleeve 46. The first sleeve 46 has first end face 48. An interior thread 50 is disposed adjacent the first end face 48. The interior thread 50 mates with the exterior thread 42 of the second electrical contact 16. Upon securing the second electrical contact 16 to the first sleeve 46, the bearing surface 44 frictionally engages the first end face 48. With the second electrical contact 16 secured to the first sleeve 46, the first and second terminals 36 and 38 are shrouded within the sleeve 46.

The end of the first sleeve 46 opposite the first end face 48 may have a first pair of diametrically disposed projections 52 extending therefrom. Each one of the first pair of diametrically disposed projections 52 has an aperture 54 passing therethrough. Similarly, a second sleeve 56 opposite the first sleeve 46 may have a second pair of diametrically disposed projections 58 extending from one end thereof. Each one of the second pair of projections has an aperture 60 passing therethrough. A universal joint member 62 has opposite ends. Holes 64, 66 pass through the opposite ends of the universal joint member 62 in directions normal to one another. The universal joint member 62 pivotally couples the first sleeve 46 and the second sleeve 56. This is accomplished by mutually aligning holes 64, 66 with respective apertures 54, 60 and by further passing pins 68, 70 through the respective mutually aligned holes 64, 66 and apertures 54, 60.

An end of the second sleeve 56 opposite the second pair of projections 58 has a journal 72 formed therein. The journal is configured to receive a terminal pad 74, a conductive pad 76, a washer 78, and a stub 26. The washer 78 separates a bearing surface of the stub 26 from a bearing surface of the journal 72 to reduce frictional wear between the stub 26 and the journal 72. The first and second sleeves 46, 56 may be diametrically separable to assist in the assembly of the electrical connector 10*a*. The terminal pad 74 is fixed to the sleeve 56. The conductive pad 76 is fixed to the stub 26. The stub 26 is permitted to rotate within the journal 72. Hence, the stub 26 and the conductive pad 76 fixed thereto are permitted to rotate relative to the sleeve 56 and the terminal pad 74 fixed to the sleeve 56.

The terminal pad 74 includes a first disk shaped member 80 having opposite sides. A set of terminals, namely, a third and fourth terminal 82, 84, extends through the first disk shaped member 80. A first end of the third and fourth terminals 82, 84 extends from a first side of the first disk shaped member 80. A first end of the third terminal 82 is physically connected to the first terminal 36. A first end of the fourth terminal 84 is physically connected to the second terminal 38. A second end of the third and fourth terminals 82, 84 extends obliquely from a second side of the first disk shaped member opposite the first side. The third and fourth terminals 82, 84 are formed of a resilient material to permit the terminals 82, 84 to be compressed.

The conductive pad 76 includes a second disk shaped member 86 having opposite sides. A set of traces 88, 90, is disposed on a first side of the second disk shaped member 86. A set of leads 92, 94 extends through the second disk shaped member 86. A first end of a first lead 92 is physically connected to a first trace 88. A first end of a second lead 94 is physically connected to a second trace 90. A second end of each of the leads 92, 94 is connected to a respective third and fourth electrical contact 96, 98 to be described hereinafter.

The terminal pad 74 and the conductive pad 76 are located within a close tolerance of one another in the journal. The second ends of the third and fourth terminals 82, 84 are compressed against the first and second traces 88, 90, respectively. As the stub 26 rotates within the journal 72, the third and fourth terminals 82, 84 remain in continuous electrical contact with the first and second traces 88, 90, respectively. This allows for a 360° rotation, while providing interruption-free electrical continuity.

The stub 26 is integral with a first end of the first receiving jack 24*a*. A second end of the first receiving jack 24*a* includes a shroud 100 having a second end face 102 and a second interior thread 104 adjacent the second end face 102. An annular member 106 includes a second exterior thread 108, a second radially extending flange 110, and an annulus 112. The third and fourth electrical contacts 96, 98 are attached to a first end of the annular member 106 adjacent the annulus 112. The third electrical contact 96, though attached to the annular member 106, is electrically insulated from the annular member 106. A third spacer 114 is interposed between the third and fourth electrical contacts 96, 98. The third spacer 114 electrically insulates the third electrical contact 96 from the fourth electrical contact 98. The third and fourth electrical contacts 96, 98, as well as the third spacer 114, each have an opening 116, 118, 120 passing therethrough. The openings 116, 118, 120 are each concentrically aligned with the annulus 112. The second exterior thread 106 mates with the second interior thread 104 of the first receiving jack 24*a*. The second radially extending flange 110 is provided with a second bearing surface 122. Upon securing the annular member 106 to the first receiving jack 24*a*, the second bearing surface 122 frictionally engages the second end face 102. The annular member 106 is attached to the first receiving jack 24*a* such that the third and fourth electrical contacts 96, 98 extend interiorly of the shroud 100. A tube 124 may be disposed within the shroud 100 interposed between the third and fourth contacts 96, 98 and the shroud 100. The tube 124 electrically insulates the third and fourth contacts 96, 98 from the shroud 100. A similar insulating tube may be employed within the first sleeve 46, and elsewhere throughout the invention, where it may be deemed appropriate to insulate the user against electrical shock.

In use, the elongated electrical connector assembly 12 may engage a receiving jack, such an electrical instrument jack (not shown). The first receiving jack 24*a* may engage an audio connector attached to the end of an audio cable (not shown). A signal may pass from the electrical instrument receiving jack through the electrical connector assembly 12, the terminal pad 74, conductive pad 76, the receiving jack 24*a*, and further through the audio cable connector. A first path is formed including the first electrical contact 14, the first terminal 36, the third terminal 82, the first trace 88, the first lead 92 and the third contact 96. A second path is formed by including the second electrical contact 16, the second terminal 38, the fourth terminal 84, the second trace 90, the second lead 94 and the fourth contact 98. The terminal pad 74 and conductive pad 76 allow for 360° rotation. The universal joint assembly 30 allows for an angular displacement of the electrical connector assembly 12 relative to the receiving jack 24*a* about two separate and arbitrary axes.

Alternative electrical connectors 10*b*, 10*c*, 10*d* are shown in FIGS. 3–5. Each of the electrical connectors 10*b*, 10*c*, 10*d* provides a plurality of contacts, as will be disclosed hereinafter. The electrical connectors 10*b*, 10*c*, 10*d* allow for 360° rotation, while providing interruption free electrical continuity. The electrical connectors 10*b*, 10*c*, 10*d* are shown in the form of audio connectors. The electrical connector 10*b* shown in FIG. 3 is a right angle audio connector. The electrical connector 10*c* shown in FIG. 4 is an audio connector having a 45° offset. The electrical connector 10*d* shown in FIG. 5 is an in-line audio connector.

Each of the electrical connectors 10*b*, 10*c*, 10*d* includes a first elongated electrical connector assembly 12. The first electrical connector assembly 12 includes a first electrical contact 14 and a second electrical contact 16. The first electrical contact includes a tip end 18 and a detent groove 20. The detent groove 20 is spaced from the tip end 18. The electrical connector assembly 12 extends from a cap assembly 22*b*, 22*c*, 22*d*. A first hollow cylindrical receiving jack 24*b* is rotationally coupled to the cap assembly 22*b*, 22*c*, 22*d* by a stub 26. The stub 26 is shown more clearly in FIG. 6. The first hollow cylindrical receiving jack 24*b* is configured to mate with a second elongated electrical connector assembly 28, such as the first elongated electrical connector assembly 12 described above.

Figure 6:
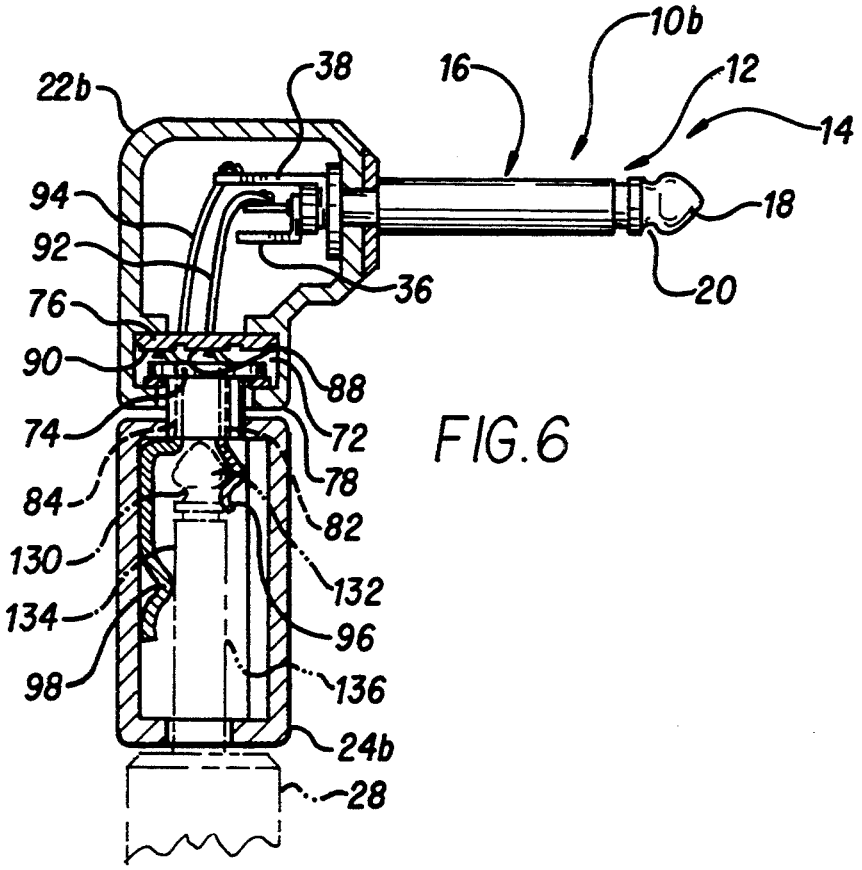
FIG. 6 is a cross-sectional view of the electrical connector shown in FIG. 3.

Referring to FIGS. 3 and 6, the right angle electrical connector 10*b* is shown. The description of the right angle electrical connector 10*b* is similar to the electrical connector 10*a* described above. The elongated electrical connector assembly 12 may be structured and configured in a manner identical to that of the electrical connector 10*a* described above. The electrical connector assembly 12 may be attached to the cap assembly 22*b* in a manner identical to that of the electrical connector 10*a* described above.

Unlike the electrical connector 10*a* described above, the right angle electrical connector 10*b* does not employ a universal joint assembly 30. The journal 72 is disposed within the cap assembly 22*b*. The cap assembly 22*b* is structured and configured to provide a 90° displacement between the elongated electrical connector assembly 12 and the journal 72. The conductor pad 76 is fixed to the cap assembly 22*b*. The terminal pad 74 is fixed to the stub 26 of the receiving jack 24*b*. The conductor pad 76, the terminal pad 74, the washer 78, and the stub 26 are disposed within the journal 72. The washer 78 is interposed between a bearing surface of the stub 26 and a bearing surface of the journal 72.

In this embodiment, the first terminal 36 is connected to the first lead 92. The second terminal 38 is connected to the second lead 94. The third terminal 82 is connected to the third electrical contact 96. The fourth terminal 84 is connected to the fourth electrical contact 98. A first path is formed including the first electrical contact 14, the first terminal 36, the first lead 92, the first trace 88, the third terminal 82, and the third contact 96. A second path is formed by including the second electrical contact 16, the second terminal 38, the second lead 94, the second trace 90, the fourth terminal 84, and the fourth contact 98.

As is shown in FIG. 6, a receiving jack 24*b* is provided for receiving an electrical connector assembly 28. The third electrical contact 96 is engageable with the dent groove 130 of a first electrical contact 132 of the electrical connector assembly 28. The fourth electrical contact 98 is engageable with the surface 134 of the second electrical contact 136 of the electrical connector assembly 28. The first electrical contact 132 of the electrical connector assembly 28 is connected to the first electrical contact 14 of the electrical connector assembly 12 via the first path. The second electrical contact 136 of the electrical connector assembly 28 is connected to second electrical contact 16 of the electrical connector assembly 12 via the second path.

Figure 7:
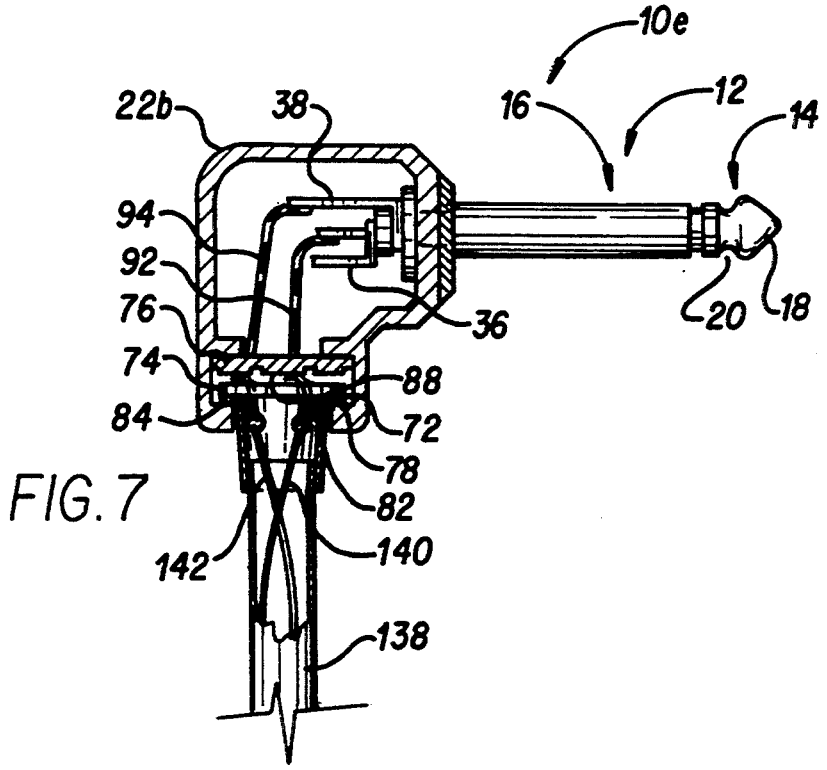
FIG. 7 is a cross-sectional view of a fourth alternative electrical connector.

As is shown in FIG. 7, an electrical cable 138 is connected to the electrical connector 10*e*. The stub 26 is configured to receive the cable 138. The cable 138 includes a first conductor 140 connected to the third terminal 82 and a second conductor 142 connected to the fourth terminal 84. The stub 26 and the cable 138 may be substituted in the place of the receiving jack 24*a*.

Similar to the electrical connector 10*a* described above, the electrical connectors 10*b* and 10*e* are provided with a stub 26 which is rotatable within the journal 72. The third and fourth terminals 82, 84 remain in continuous electrical contact with first and second traces 88, 90, respectively. This allows for a 360° rotation, while providing interruption-free electrical continuity.

The electrical connectors 10*a*–10*e* have been shown for a typical shielded audio plug especially useful for transferring electrical signals from electrical instruments to amplification equipment and in preventing audio cords from twisting. Moreover, although the electrical connectors 10*a*–10*e* have been shown for a typical shielded audio plug having a pair of contacts 14 and 16 along an elongated electrical connector assembly 12, it will be appreciated that numerous variations can be made. An electrical connector (not shown) can be configured with or without an electrical cable at both ends, eliminating the need for the electrical connector assembly 12 and the receiving jack 24. An electrical connector (not shown) can be fabricated including two electrical connector assemblies 12, providing a second electrical connector assembly 12 in the place of the receiving jack 24. Conversely, an electrical connector (not shown) can be structured including two receiving jacks 24, providing a second receiving jack in the substitution of the electrical connector assembly 12. Other changes are intended to be within the spirit of the invention and can be made by one skilled in the art.

Although electrical connectors having only two electrical contacts are shown, the electrical connector could be structured and configured having greater than two contacts. The electrical connectors could be configured to accommodate electrical plugs for extension cords and electrical appliances, such as hair dryers, lawn mowers, hand tools, and household appliances.

For these and other reasons, it is to be understood that the present invention is not limited to the embodiments described above, but encompasses any and all embodiments within the scope of the following claims.

I claim:

1. An electrical connector which is rotatable, while providing interruption-free electrical continuity, comprising:

a plurality of electrical terminals including at least a first set of electrical terminals and a second set of electrical terminals;

a terminal pad connected to said first set of electrical terminals;

a conductive pad connected to said second set of electrical terminals, said conductive pad being engageable with said terminal pad, said conductive pad further being rotatable relative to said terminal pad so as to rotate said second set of electrical terminals relative to said first set of electrical terminals;

a first housing for accommodating said first set of electrical terminals, said terminal pad, and said conductive pad;

an electrical connector assembly extending from said first housing, said electrical connector assembly having at least a first set of contacts being connected to said first set of electrical terminals, said electrical connector assembly includes an audio plug; and a second housing for accommodating said second set of electrical terminals, said second housing being rotatably engageable with said first housing.

2. The electrical connector according to claim 1, wherein said first housing further includes a universal joint assembly, said first and second housings being angularly displaceable relative to one another, said first housing is angularly displaceable about a first axis and said second housing is angularly displaceable about a second axis.

3. The electrical connector according to claim 2, wherein said universal joint assembly is structured and configured such that said first axis extends normal to said second arbitrary axis.

4. The electrical connector according to claim 1, further includes a second set of contacts disposed within said second housing and connected to said second set of terminals, said second housing and said second set of contacts cooperatively form a receiving jack.

5. The electrical connector according to claim 4, wherein said receiving jack includes an audio receiving jack.

6. The electrical connector according to claim 1, further includes a cable including a set of conductors, said cable extending from said second housing, and said set of conductors being connected to said second set of terminals.

7. An electrical connector which is rotatable, while providing interruption-free electrical continuity, comprising:

first and second contacts structured to form an audio plug;

first and second electrical terminals, said first and second contacts of said audio plug being electrically connected to said first and second terminals, respectively;

a terminal pad including third and fourth electrical terminals, said third and fourth terminals being of a resilient electrically conductive material, said third and fourth terminals being electrically connected to said first and second terminals, respectively;

a conductive pad having at least a first and a second side, said conductive pad including at least a first and a second conductive ring located on said first side of said conductive pad, an insulating material electrically isolating said first conductive ring from said second conductive ring, and at least a first and a second electrically conductive lead extending from said second side of the conductive pad, said first and second conductive rings being rotatably engageable with said third and fourth terminals, respectively, and said first and second electrically conductive leads being electrically connected to said first and second conductive rings, respectively;

third and fourth electrical contacts, said third and fourth electrical contacts being electrically connected to said first and second electrically conductive leads, respectively;

a first housing having an interior for accommodating said first and second electrical terminals and said terminal pad therein, said first and second electrical terminals and said terminal pad being fixed relative to said housing, said first and second electrical terminals further being fixed relative to said third and fourth electrical terminals; and a second housing having an interior for accommodating said first and second electrically conductive leads, said conductive pad and said first and second contacts of said audio plug being fixed relative to said housing, said first and second electrically conductive leads further being fixed relative to said third and fourth electrical contacts, said second housing being rotatably engageable with said first housing, providing interruption-free electrical continuity between said first and second contacts of said audio plug and said third and fourth contacts, respectively.

8. The electrical connector according to claim 7, wherein said first housing further includes a universal joint assembly, said first and second housings being angularly displaceable relative to one another, said first housing is angularly displaceable about a first axis and said second housing is angularly displaceable about a second axis.

9. The electrical connector according to claim 8, wherein said first housing includes at least a first end and a first pair of diametrically disposed projections projecting from said first end of said housing, each one of said first pair of diametrically disposed projections having an aperture passing therethrough, and wherein said universal joint assembly includes at least:

a sleeve having a first end and a second pair of diametrically disposed projections projecting from said first end of said sleeve, each one of said second pair of projections having an aperture passing therethrough;

a universal joint member having opposite ends and first and second holes passing through said opposite ends, said first hole mutually aligning with said apertures in said first pair of projections and said second hole mutually aligning with said apertures in said second pair of projections; and a first and second pin, said first pin passing through said first hole in mutual alignment with said apertures in said first pair of projections, and said second pin passing through said second hole in mutual alignment with said apertures in said second pair of projections.

10. The electrical connector according to claim 8, wherein said universal joint assembly is structured and configured such that said first axis extends normal to said second axis.

11. The electrical connector according to claim 7, wherein said third and fourth contacts are structured and configured and arranged within said second housing so as to form a receiving audio jack.

12. The electrical connector according to claim 7, further includes an electrical cable including at least a first and second conductor, said cable extending from said second housing, said first and second conductors being electrically connected to said third and fourth contacts.

13. An electrical connector which is rotatable, while providing interruption free electrical continuity, comprising:

at least a first and second contact;

at least a first and second electrical terminal, said first and second contacts being electrically connected to said first and second terminals, respectively;

a terminal pad including at least a third and fourth electrical terminal, said third and fourth terminals being of a resilient electrically conductive material, said third and fourth terminals being electrically connected to said first and second terminals, respectively;

a conductive pad having a first and second side, said conductive pad including at least a first and second conductive ring located on said first side of said conductive pad, an insulating material electrically isolating said first conductive ring from said second conductive ring, and at least a first and second electrically conductive lead extending from said second side of conductive pad, said first and second conductive rings being rotatably engageable with said third and fourth terminals, respectively, and said first and second leads being electrically connected to said first and second conductive rings, respectively;

at least a third and fourth electrical contact, said third and fourth electrical contacts being electrically connected to said first and second leads, respectively;

a first housing having at least a first end and a first pair of diametrically disposed projections projecting from said first end of said housing, each one of said first pair of diametrically disposed projections having an aperture passing therethrough, said housing further having an interior for accommodating said first and second electrical terminals and said terminal pad therein, said first and second electrical terminals and said terminal pad being fixed relative to said housing, said first and second electrical terminals further being fixed relative to said third and fourth electrical terminals;

a second housing having an interior for accommodating said first and second leads, said conductive pad and said first and second contacts being fixed relative to said housing, said first and second leads further being fixed relative to said third and fourth electrical contacts, said second housing being rotatably engageable with said first housing, providing interruption free electrical continuity between said first and second contacts and said third and fourth contacts, respectively; and a universal joint assembly including at least:

a sleeve having a first end and a second pair of diametrically disposed projections projecting from said first end of said sleeve, each one of said second pair of projections having an aperture passing therethrough;

a universal joint member having opposite ends and first and second holes passing through said opposite ends, said first hole mutually aligning with said apertures in said first pair of projections and said second hole mutually aligning with said apertures in said second pair of projections; and a first and second pin, said first pin passing through said first hole in mutual alignment with said apertures in said first pair of projections, and said second pin passing through said second hole in mutual alignment with said apertures in said second pair of projections.

* * * * *